United States Patent [19]

Herriott

[11] 4,228,667

[45] Oct. 21, 1980

[54] MAGNETICALLY ACTING LOCK AND KEY

[75] Inventor: Leslie V. Herriott, Wolverhampton, England

[73] Assignee: Lowe and Fletcher Limited, West Midlands, England

[21] Appl. No.: 970,175

[22] Filed: Dec. 18, 1978

Related U.S. Application Data

[63] Continuation of Ser. No. 778,333, Mar. 16, 1977, abandoned.

[30] Foreign Application Priority Data

Mar. 16, 1976 [GB] United Kingdom ..... 10416/76
Oct. 6, 1976 [GB] United Kingdom ..... 41429/76

[51] Int. Cl.[3] ..... E05B 19/26; E05B 27/00; E05B 47/00

[52] U.S. Cl. ..... 70/276; 70/413

[58] Field of Search ..... 70/276, 413, 378, 360

[56] References Cited

U.S. PATENT DOCUMENTS

| | | | |
|---|---|---|---|
| 1,154,078 | 9/1915 | Upton | 70/378 |
| 1,434,110 | 10/1922 | Freysinger | 70/378 |
| 2,049,742 | 8/1936 | Lowe | 70/422 X |
| 2,121,301 | 6/1938 | Ractliffe | 70/413 X |
| 2,177,996 | 10/1939 | Raymond | 70/276 |
| 3,234,767 | 2/1966 | Allander | 70/276 |
| 3,421,348 | 1/1969 | Hallmann | 70/276 |
| 3,602,020 | 8/1971 | Kajita | 70/276 |
| 3,757,551 | 9/1973 | Willach | 70/276 |
| 3,965,710 | 6/1976 | McCurdy | 70/422 X |
| 3,967,479 | 7/1976 | Vick | 70/276 |

FOREIGN PATENT DOCUMENTS

| | | | |
|---|---|---|---|
| 1359748 | 3/1964 | France | 70/276 |
| 56992 | 7/1967 | German Democratic Rep. | 70/276 |

*Primary Examiner*—Rodney H. Bonck
*Attorney, Agent, or Firm*—Spencer & Kaye

[57] ABSTRACT

A lock for operation by a magnetic key has locking elements in the form of rollers which can be moved along respective channels in the lock by the magnetic field of the key. Each channel is formed partly in the peripheral surface of a rotatable barrel of the lock and partly in a surrounding sleeve. The barrel can be rotated only when each sleeve is free to move axially relative to the barrel. In the absence of the key, the rollers prevent such axial movement. When the rollers are moved to predetermined releasing positions by the key, they are aligned with respective notches in the sleeves so that axial movement is permitted.

9 Claims, 8 Drawing Figures

FIG.1.
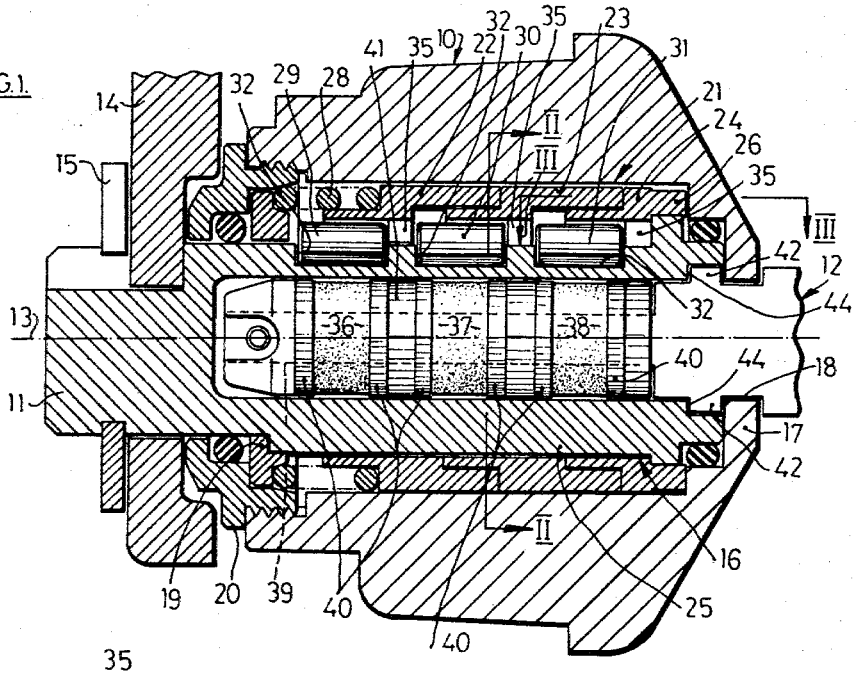
FIG.2.
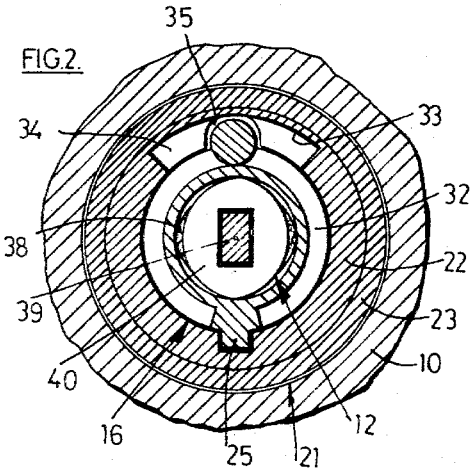
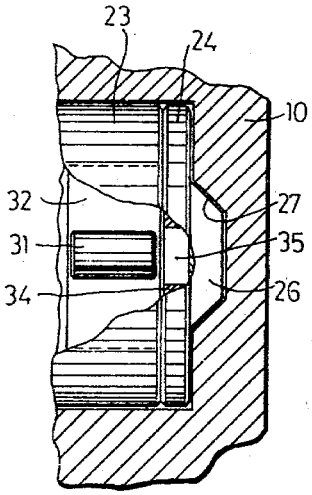
FIG.3.
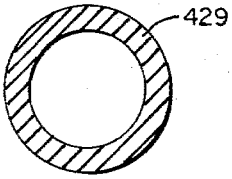
FIG.8

MAGNETICALLY ACTING LOCK AND KEY

CROSS REFERENCE TO RELATED APPLICATION

This application is a continuation of application Ser. No. 778,333, filed Mar. 16th, 1977 and now abandoned.

BACKGROUND OF THE INVENTION

Field of the Invention

From one aspect, the present invention relates to a lock intended for operation by a key with which there is associated a magnetic field.

There are known locks of this kind which include a plurality of channels and a plurality of magnetic elements disposed in respective ones of the channels for movement there along, the magnetic elements preventing operation of the lock when the key is absent and the magnetic elements being moved, when the proper key is applied to the lock, by the magnetic field of the key along the channels into predetermined releasing positions such that they no longer prevent operation of the lock.

By a "magnetic element" we mean an element which is subjected to a substantial force when placed in a magnetic field. The magnetic element may comprise a permanent magnet or be formed of a ferro-magnetic material which is not permanently magnetised.

SUMMARY OF THE INVENTION

It is an object of the invention to improve the reliability of locks of the kind referred to.

According to the first aspect of the invention, a lock of the kind referred to comprises magnetic elements in the form of rolling elements, each magnetic element being arranged to roll along its channel into and out of its releasing position.

According to a second aspect of the invention there is provided a key for use in a lock according to the first aspect, which key has a plurality of magnetised regions which are distributed along the key, there being associated with each magnetised region a magnetic field which is directed around a longitudinal axis of the key.

By the expression "a magnetised region" we mean a region with which there is associated a permanent magnetic field.

BRIEF DESCRIPTION OF THE DRAWINGS

FIG. 1 shows a lock and a key for operation thereof, the lock being shown in longitudinal cross section and the key being present in a key-receiving member of the lock;

FIG. 2 shows a cross section on the line II—II of Figure;

FIG. 3 shows a fragmentary cross section on the line III—III of FIG. 1;

FIG. 8 is a cross section of a modified element incorporated in a lock according to the present invention.

DETAILED DESCRIPTION

Figure 4:
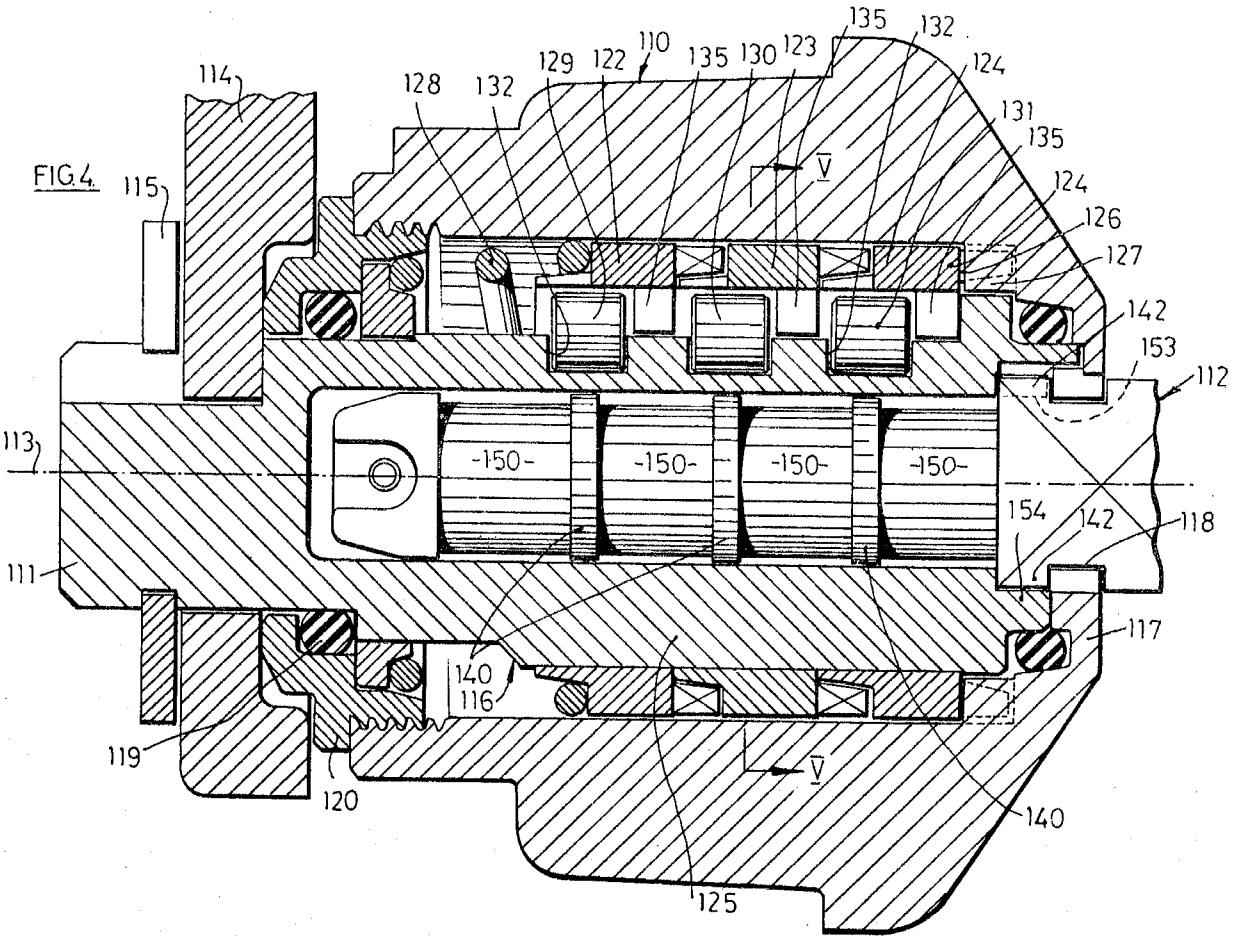
FIG. 4 shows diagrammatically a modification of the lock and key shown in FIG. 1.

The lock shown in FIG. 1 comprises a body 10 which, when the lock is in use, is normally disposed in a housing of a device to be controlled by the lock. From one end of the body, called herein the inner end, there projects a driving member 11 which, when the correct key 12 is applied to the lock, can be rotated about a longitudinal axis 13 of the lock to release or operate the associated device. As shown in FIG. 1, a driven member 14 of the device may be received on the driving member 11, keyed thereto and retained thereon by a circlip 15.

The associated device may be a bolt or latch for a door or drawer, in which case the driven member 14 may be in the form of a crank for moving the bolt or latch. Alternatively, the lock could be incorporated in a vehicle anti-theft device, in which case the driven member 14 may be a cam arranged for moving a bolt of the device substantially in a known manner.

The driven member 11 is integral with or rigidly secured to a key-receiving member of the lock which is in the form of a barrel 16. The barrel is rotatable about the axis 13 during operation of the lock and is constrained at all times against axial movement relative to the body 10. An outer end face of the barrel is presented towards and engageable with a radially inwardly projecting flange 17 on the body 10, which flange defines an opening 18 in the body for receiving the key 12. An axially inwardly facing shoulder on the barrel abuts a ring 19 which is in sliding contact with an annular closure member 20. The closure member is secured in the inner end of the body 10 by a screw thread and prevents axially inward movement of the ring 19. The ring is keyed to the barrel. It will be seen that the driving member 11 projects through the central opening of the closure member 20 and is freely rotatable therein.

Also disposed within the body 10, there is an obstructing member 21 for obstructing rotation of the barrel 16 when the proper key is absent therefrom. The obstructing member is in the form of a sleeve and, for convenience of manufacture and assembly, is formed in three parts, 22, 23 and 24, each of which is a sleeve. The sleeve 22 forms the axially inner end of the obstructing member, the sleeve 24 forms the axially outer end of the obstructing member and the sleeve 23 forms the middle of the obstructing member. The middle sleeve 23 has a smaller diameter portion which is received within a larger diameter portion of the sleeve 22 and a larger diameter portion within which a smaller diameter portion of the sleeve 24 is received. The barrel 16 is formed at one side with a longitudinally extending spline 25 which is received in aligned, axially extending grooves formed in the radially inwardly presented faces of the sleeves 22, 23 and 24. This spline therefore constrains the obstructing member to rotate with the barrel but permits axial movement of the obstructing member relative to the barrel.

From the axially outwardly presented face of the sleeve 24 there projects a cam formation 26. When the key is absent from the lock and the obstructing member is in the outer position shown in FIG. 1, this cam formation is received in a corresponding recess 27 formed in a rearwardly presented internal face of the body 10. Whilst the cam formation is situated in this recess, rotation of the sleeve 24 and therefore of the other sleeve and of the barrel 16 is prevented. The obstructing member 21 is urged in the outward axial direction by a spring 28 so that the cam formation 26 remains in the recess 27 whenever the rotational position of the sleeve 24 is such that the formation 26 is in alignment with the recess 27. The shape of the cam formation 26 is such that it can be driven out of the recess 27 by rotation of the sleeve 24, provided that axial movement of the sleeve 24 relative to the body 10 and therefore relative to the barrel 16 is permitted. The spring 28 abuts the ring 19 and as the ring turns with the barrel, friction between the spring and the ring is of no consequence. The ring slides freely on the closure member 20.

In the absence of the proper key, each one of the sleeves 22, 23 and 24 is constrained against axial movement relative to the barrel 16 by respective magnetic locking elements 29, 30 and 31. Other parts of the lock are formed of non-magnetic materials. Accordingly, the elements 29, 30 and 31 can be controlled by a suitably magnetised key. When the proper key is inserted into a keyway of the barrel 16, the elements 29, 30 and 31 are moved into releasing positions such that the sleeves 22, 23 and 24 are freed for axial movement relative to the barrel.

In the radially outwardly presented face of the barrel 16, there are formed three circumferentially extending grooves 32. These grooves do not extend completely around the axis 13 but subtend an angle of approximately 300° thereat. Each of the grooves 32 lies radially inwardly of a corresponding one of the sleeves 22, 23 and 24. Each sleeve is formed in its radially inner face with an arcuate recess 33, the position of which along the axis 13 is the same as that of the corresponding groove 32 when the parts are in the position shown in FIGS. 1 and 2. The axial extent of each recess 33 is the same as that of each groove 32. Each recess 33, together with a part of its corresponding groove 32, forms a channel in which a corresponding one of the locking elements 29, 30 and 32 is received. The locking elements are in the form of cylindrical rollers and are arranged to roll along their respective channels on their peripheral faces. The axial extent of each locking element is only slightly less than that of the corresponding groove 32, so that the locking elements can move freely along their respectively channels but are constrained against axial movement relative to the barrel 16.

The recess 33 of each of the sleeves 22, 23 and 24 is bounded at its axially outermost side by a wall 34 in which there is formed at least one notch 35. The notch is of sufficient size to accommodate that part of the transverse cross-section of the associated locking element which projects from the groove 32. Accordingly, if each locking element is aligned axially with that notch 35 of its corresponding sleeve, the sleeve can move axially relative to the barrel in the inward direction so that the locking element enters the notch. If one locking element is not completely aligned with its notch, axial movement of the associated sleeve and therefore of the obstructing member as a whole relative to the barrel is prevented by engagement of the end faces of the locking element with abutment surfaces 34 at opposite sides of the channel formed on the barrel and on the obstructing member respectively.

The locking elements 29, 30 and 31 present for engagement with the walls 34 of the associated sleeve 22, 23 and 24 and for engagement with the walls of the grooves 32 flat end faces. With this arrangement, even a small degree of overlap between the end face of the locking element and the abutment face of the associated sleeve will prevent axial movement of the obstructing member. Furthermore, the locking elements will not readily deform the associated sleeves even under high axial pressures.

When the key is absent from the lock, each of the locking elements 29, 30 and 31 will occupy a locking position which will normally be the lowest position that locking element can reach by movement along its channel. In its locking position, each locking element is engaged between the barrel 16 and an associated one of the sleeves 22, 23 and 24 in such a manner as to prevent axial movement of the sleeve from the position shown in FIG. 1. When the key is withdrawn, the locking elements are moved to their locking positions by gravity.

The key 12 is adapted to so control the locking elements 29, 30 and 31 that, when the key is applied to the lock, each of these elements is moved from its locking position into and is held in its releasing position, in which the locking element is aligned with the corresponding notch 35. The key has three magnetised regions, each comprising a permanently magnetised element 36, 37 and 38 of approximately annular form. The magnetised elements (magnets) are carried on a stem 39 of the key which extends through the central openings. Each magnet has a pair of pole faces, these being presented in opposite directions along the key so that its unlike poles are spaced apart longitudinally of the key and of the axis 13. Adjacent to each pole face there is a magnetic conductor 40, the conductors also being of approximately annular form and carried on the stem 39.

It is the respective forms of the conductors 40 which determines the positions to which the locking elements 29, 30 and 31 are moved by the key. In the particular example illustrated in FIG. 1, there is one conductor 40 for each pole face of each magnet and adjacent conductors associated with different magnets are spaced apart by shield elements 41. These shield elements have a low magnetic permeability and shield the conductors associated with one magnet from the field associated with an adjacent magnet. When the key is fully inserted into the barrel 16, the two conductors 40 associated with the magnet 36 are substantially in alignment with opposite end portions of the locking element 29. The conductors associated with the magnets 37 and 38 have a similar relationship to the locking elements 30 and 31 respectively.

The shape of the magnetic conductors 40 is such, relative to the paths along which the locking elements 29, 30 and 31 move between their locking and releasing positions that the distance between each locking element and the associated conductors varies as the locking element moves along its channel and is a minimum at the releasing position. In the particular example shown, each locking element is free to move along a path which forms an arc of a circle centered on the axis 13. As viewed in a direction along the key, the conductors 40 have non-circular profiles as shown in FIG. 2. One part of the periphery of each conductor (corresponding to the releasing position of the associated locking element) is situated at least as far from the axis 13 as are all other parts of the periphery and further from the axis than most of the periphery. In the example illustrated in FIG. 5, two parts of the periphery which are separated angularly about the axis 13 by 180°, are situated further from the axis than all other parts of the periphery. This enables the locking elements to be set in their releasing positions when the key is inserted into the barrel in either one or two alternative angular positions which differ by 180° about the axis 13.

The cross section of the stem 39 is non-circular and the central opening of each conductor 40 has a corresponding shape, so that the conductors cannot turn relative to the stem. For convenience of illustration, the particular example illustrated in FIGS. 2 and 3 is such that the locking elements 29, 30 and 31 are in axial alignment with one another when in their releasing positions. Accordingly, all of the magnetic conductors 40 are identical. Different samples of the lock would be produced with different releasing positions of the locking elements. The angular relation between the position of the notch 35 and of the formation of each sleeve which receives the key 25 being modified and the angular relation between the profile of the conductors 40 and the central aperture thereof being modified accordingly.

The use of two magnetic conductors 40 in association with each of the locking elements 29, 30 and 31, as shown in FIG. 1, is preferred in a case where the locking elements are fairly short. The use of two conductors in this manner provides better control over the locking element with regard to the maintenance of a parallel relationship between the axis of the locking element and the axis 13 than would be likely to be established by the use of a single conductor in association with a short locking element.

As shown in FIG. 2, in the particular example illustrated in FIGS. 1, 2 and 3, the notch 35 of each of the sleeves, 22, 23 and 24 is situated half way along the recess 33. In different samples of the lock, the notch may be situated away from the middle of the recess 33 so that locks having the recesses 33 similarly positioned cannot be operated by the same key, the key being required to correspond to the positions of the notches 35. A number of locking elements greater than 3 may be provided in the lock, the number of sleeves in the obstructing member being increased accordingly.

To enable torque to be transmitted from the key 12 to the barrel 16, the key is provided with a pair of radial projections 42 which project from a part of the key lying between the stem 39 and a handle portion of the key (not shown). When the key is inserted into the lock, these projections pass through diametrically notches in the flange 17 and engage in recesses 44 in the barrel 16. These recesses are open at their outer ends, but are closed at their inner ends so that axially inwardly directed force can also be transmitted from the key to the barrel by the projections 42.

When the key is inserted into the lock, each of the locking elements 29, 30 and 31 is moved to its releasing position. This frees the obstructing member 21 for axial movement relative to the barrel 16. The key can then be rotated to rotate the barrel and obstructing member about the axis 13. During an initial part of such rotation, the cam formation 26 drives the obstructing member 21 axially inwardly until the cam formation is completely withdrawn from the recess 27. Further rotation can then take place without any axial movement occurring. Until the key is returned to the initial position by reverse rotation, the key is retained in the lock as the projections 42 are situated axially inwardly of the flange 17 and would engage this flange if an attempt is made to withdraw the key.

If required, each of the sleeves 22, 23 and 24 may be formed with more than one notch 35. This would enable the lock to be operated by at least two different keys, one of which could be a master key for operating a suite of locks.

If, whilst the key is absent from the lock, an attempt is made to move the barrel 16 by means of some other instrument inserted into the lock, the application of torque to the barrel will, through the action of the cam formation 26, result in the application to the obstructing member 21 of an axially inwardly directed force. This will establish pressure contact between, on the one hand, the end faces of the locking elements 29, 30 and 31 and, on the other hand, the abutment surfaces 34 of the corresponding sleeves 22, 23 and 24 and the barrel 16. Such contact pressure will establish sufficient friction to prevent subsequent movement of the locking elements to their releasing positions until the application of torque to the barrel is discontinued.

When torque is applied to the barrel 16 by means other than the correct key, the locking elements 29, 30 and 31 are not required to withstand the entire force applied to the barrel. Friction between the cam projection 26 and the body 10 is such that, when axial movement of the obstructing member 21 is prevented, the major part of any torque applied to the barrel is resisted by cooperation between the cam projection and the body. The cam projection can be made sufficiently large to ensure that unauthorised rotation of the barrel 16 is prevented and the sleeve 24, including the cam projection, can be formed of a strong material, for example steel.

In the particular example of lock illustrated in FIGS. 2 and 3, the locking elements 29, 30 and 31 are formed of a magnetic materials but are not permanently magnetised. These elements are therefore urged to the positions along their respective paths of movement at which the density of the magnetic flux established by the key is greatest, irrespective of the polarity of each magnetised region of the key. If required, each locking element could be permanently magnetised, in which case only a key having an appropriate polarity of each magnetised region would be capable of operating the lock. It is intended that the key should be assembled with the magnets 36, 37 and 38 in an unmagnetised condition and that the key should then be treated to permanently magnetise these magnets with the required polarities. The magnets 36, 37 and 38 may be formed of a sintered ferrite. The magnetic conductors 40 are formed of a magnetic steel, preferably one having high carbon content.

A plurality of different locks may be arranged so that they can be operated by a single key. Such key would have one or more magnetic conductors of such a form that there are a plurality of positions around the axis of the key and at the same distance from that axis at which the strength of the magnetic field is greater than at other positions. The locks would be arranged to provide different paths of movement for their locking elements, each path corresponding to a respective one of the maximum field strength positions of the key.

Figure 5:
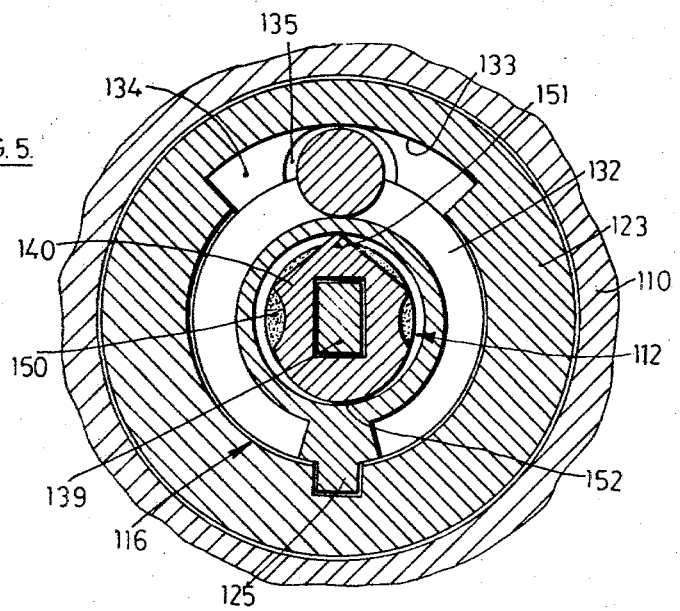
FIG. 5 shows a cross section on the line V—V of FIG. 4.

As shown in FIG. 2, the profile of each magnet of the key is non-circular. However, for convenience of production and assembly of the lock, we prefer to provide circular magnets so that different keys will differ only in respect of the shapes of the magnetic conductors. In FIGS. 4 and 5, there is illustrated a modification of the lock and key combination of FIG. 1 whereof the key has magnets with a circular profile. In FIG. 4 parts corresponding to those already described with reference to FIGS. 1 to 3 are indicated by like reference numerals with the prefix 1 and the preceeding description is deemed to apply, except for the difference hereinafter mentioned.

In the key 112 shown in FIG. 4, each magnetic conductor 140 modifies the field of two magnets 150. These two magnets lie on opposite sides of the conductor and present towards the conductor like magnetic poles. The key of FIG. 4 comprises only a single conductor to control each one of the locking elements 129, 130 and 131 and these locking elements are short, as compared with the locking elements shown in FIG. 1.

The cam formation 126 on the sleeve 124 of the lock of FIG. 4 is a female formation and a complementary male cam formation 127 is provided on the flange 117 of the body.

As shown in FIG. 5 the profile of each magnetic conductor 140 is non-circular. However, the conductor overlaps with almost the whole of the pole face (end face) of each adjacent magnet 150. At two diametrically opposite positions 151 and 152, the periphery of the conductor is spaced from the axis 13 by a distance greater than the radius of the magnets 150. One of these positions, depending upon which way up the key is inserted, lies adjacent to the path along which the corresponding locking element 129, 130 and 131, can move. Since this particular part of the profile of the conductor is closer to the path than is any other part of the profile, the locking element will be attracted to a position in which it lies on the diameter through the parts 151 and 152 of the conductor. This is the releasing position of the locking element, in which it is aligned with the notch 135 of the corresponding sleeve. In different keys intended to operate different samples of lock, the profile of the conductors would have an angular relation to the key stem in accordance with the different releasing positions of the locking elements.

The barrel 116 is provided with only one recess to receive a projection 142 of the key. This recess is defined between two axially projecting pegs 153 (one of which is shown) on the barrel. If excessive torque is applied to either of these pegs, for example by an attempt to force the lock without the proper key, the peg will shear off the barrel. At a position diametrically opposite to that of the recess 144, there is provided on the barrel a radial projection 154 which can engage with an abutment on the body 110 to limit rotation of the barrel relative to the body.

Figure 6:
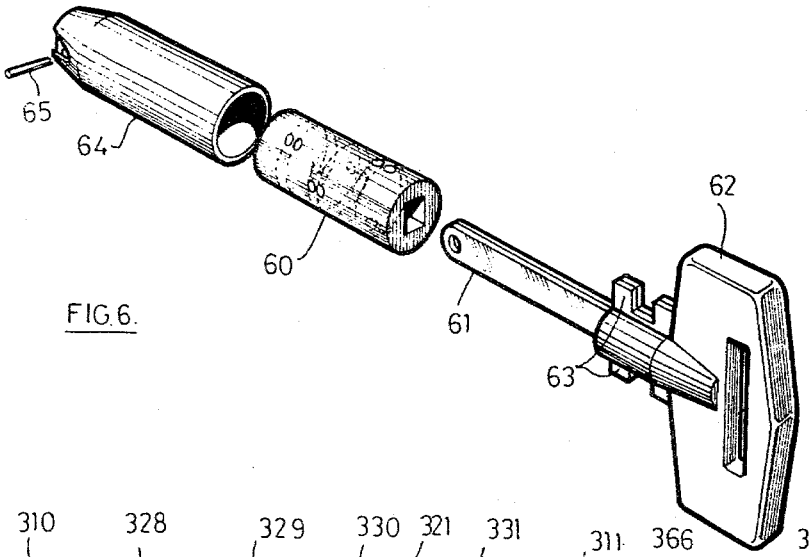
FIG. 6 shows an alternative form of key which may be used in combination with the locks of FIGS. 1 and 4, parts of the key being shown disassembled from one another and, FIG. 7 shows diagrammatically a further example of a lock in accordance with the invention.

In FIG. 6 there is illustrated an alternative form of key which may be combined with the lock shown in FIG. 1 or with the lock shown in FIG. 4. The key of FIG. 6 comprises a magnetised body 60 of cylindrical form which has a central opening off non-circular cross section in which there is received a shank 61 having a corresponding cross section. On one end of the shank, there is provided a handle portion 62 which can be grasped by a user. Between the body 60 and the handle portion 62, there is on the shank a pair of radial projections 63 which transmit torque to a barrel of the lock. The body 60 is covered by a sheath 64 which is conveniently formed as a moulding of a plastics material. A pin 65 extends through the sheath and through an aperture in the free end of the shank 61 to retain the body 60 and sheath 64 on the shank.

The body 60 is formed of a material which can be permanently magnetised. A sintered ferrite, for example barium ferrite, is a suitable material for the body 60. After this body has been formed, it is magnetised in such a manner as to produce spot magnetic poles on the circumferential face of the body. Such poles can be produced by electromagnetic probes in a known manner, the positions of the probes being selected according to the required positions of the spot poles in the key. Thus, spot poles can be produced at various positions corresponding to the releasing positions of the magnetic elements of the lock which the key is to operate.

Preferably, the body 60 is provided with a plurality of pairs of magnetic poles, each pair comprising a north pole and a south pole which are spaced apart along the key by a distance corresponding approximately to the length of a magnetic element of the lock which the key is to operate. At least one pair of poles is provided for each magnetic element, but we prefer to provide for each magnetic element two pairs of poles, these pairs being situated at diametrically opposite positions on the body 60 so that the key can be inserted into the lock in a selected one of two alternative positions which differ by 180° about the axis of the lock.

Figure 7:
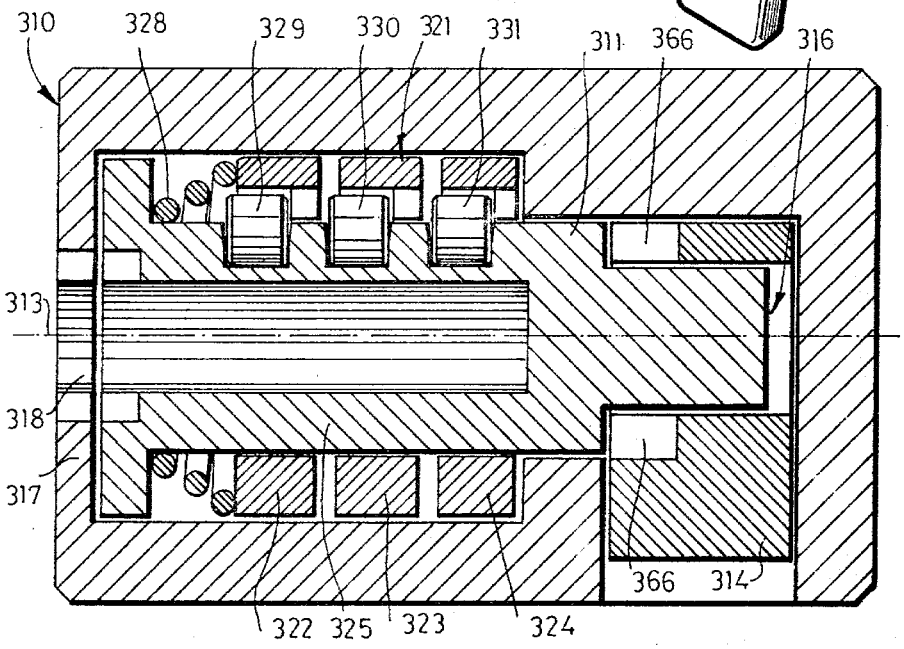

A further example of a lock in accordance with the invention is shown diagrammatically in FIG. 7. Certain parts shown in FIG. 7 correspond to parts already described with reference to FIGS. 1, 2 and 3 and such corresponding parts are indicated by like reference numerals with the prefix 3. Except for the difference hereinafter mentioned, the preceding description is deemed to apply to such corresponding parts.

The driven member 314 of the lock shown in FIG. 7 is not permanently keyed to the driving member 311 which, in this example, is an integral part of the barrel 316. The driven member 314 is constrained against movement along the axis 313 by the body 310. When the proper key is present in the barrel 316, the barrel can move along the axis 313 between an outer position shown in FIG. 7, in which it can rotate relative to the driven member 314, and an inner position in which the driving member engages in recesses 366 in the driven member to cause the latter to rotate with the barrel.

When the key is absent, movement of the barrel 316 along the axis 313 is prevented by an obstructing member 321 which, for convenience of manufacture, is formed as three separate sleeves 322, 323 and 324. Magnetic elements 329, 330 and 331 act between the obstructing member 321 and the barrel 316 to prevent relative axial movement unless the magnetic elements are first moved about the axis 313 to releasing positions. The obstructing member 321 is urged axially inwardly relative to the barrel 316 by a spring 328.

The obstructing member is caused to rotate with the barrel by a key portion 325 of the barrel.

When the proper key is inserted into the barrel 316, the magnetic elements 329, 330 and 331 are moved along their respective channels to releasing positions in which they are aligned with notches in the sleeves 321, 322 and 323. The barrel can then be pushed axially inwardly so that the driving member 311 engages in the recesses 366. The barrel is then turned by means of the key to rotate the driven member 314. When the key is withdrawn, the spring 328 moves the barrel axially outwardly relative to the obstructing member 321. Since the magnetic elements 329, 330 and 331 are in grooves in the barrel, they are withdrawn from the notches in the sleeves 322, 323, and 324 and so permitted to move to locking positions under the influence of gravity.

In all cases where the magnetic elements of the lock are in the form of rollers, these can be solid, hollow or recessed at their ends, provided that a flat surface is provided at each end for cooperation with the barrel and the obstructing member respectively. FIG. 8 shows such a hollow roller 429.

I claim:

1. In a lock comprising a barrel which is adapted to receive a key and, when the proper key is applied to the barrel, is rotatable about an axis of the barrel, an obstructing member which is movable longitudinally of the axis of rotation of the barrel between a first position in which the obstructing member obstructs movement of the barrel to operate the lock and a second position in which the obstructing member does not obstruct said movement of the barrel and a plurality of magnetic elements which, at least in the absence of the key, engage between the barrel and the obstructing member to prevent movement of the obstructing member relative to the barrel from its first position to its second position, the improvement wherein the magnetic elements are in the form of rolling elements, the barrel has an elongate keyway to receive the key, the obstructing member is in the form of a sleeve and surrounds the barrel, the barrel and the obstructing member collectively define a plurality of channels in which the magnetic elements are disposed and along which the magnetic elements are movable by a magnetic field of the proper key to releasing positions where they permit movement of the obstructing member from its first position to its second position, each of said channels is formed partly in the obstructing member and partly in the barrel and the formations in the barrel which constitute part of each channel are longer thans the corresponding formations in the obstructing member.

2. In a lock comprising an operating member, a further member which is movable relative to the operating member, a channel defined by the operating member and the further member collectively, a magnetic element disposed in a movable along the channel by a magnetic field and abutment surfaces at opposite sides of the channel, the abutment surfaces facing in the opposite directions in which the relative movement of the operating member and further member can occur, the abutment surfaces being formed on the operating member and on the further member respectively and the abutment surfaces being engageable concurrently with the magnetic element except when the magnetic element occupies a predetermined releasing position in the channel, whereby movement of the operating member relative to the further member to operate the lock is prevented by engagement of the magnetic element with the abutment surface except when the magnetic element occupies its releasing position, the improvement wherein the magnetic element is formed as a cylinder having a peripheral face and opposite end faces and the cylinder is arranged with its axis transverse to the length of its channel, whereby the cylinder can roll along its channel on its peripheral face, and end faces of the cylinder are presented towards said abutment surfaces, whereby engagement between the abutment surfaces and the cylinder occurs solely at the end faces of the cylinder.

3. The improvement according to claim 2 wherein the operating member is a barrel which, when the magnetic element is in its releasing position, is rotatable about an axis, said channel extends circumferentially of the axis around the barrel, said abutment surfaces face along the axis and constraining means other than the magnetic element is provided for constraining the barrel against movement along the axis throughout operation of the lock.

4. The improvement according to claim 3 wherein said further member is arranged for movement along said axis when the magnetic element is in the releasing position and means is provided for displacing the further member axially relative to the barrel when the barrel is rotated and for preventing rotation of the barrel when axial displacement of the further member is prevented by the magnetic element.

5. The improvement according to the claim 2 wherein the operating member is a barrel, said further member is in the form of a sleeve and surrounds the barrel, said channel is formed partly in the barrel and partly in said further member and the formation in the barrel which constitutes a part of the channel is longer than the corresponding formation in said further member.

6. The improvement according to claim 2 wherein said abutment surfaces are flat.

7. The improvement according to claim 2 wherein the lock has an internal keyway for receiving a key.

8. The improvement according to claim 2 wherein the magnetic element is hollow.

9. The improvement according to claim 8 wherein the magnetic element comprises a hollow cylindrical body of magnetic material.

* * * * *